United States Patent [19]

Irwin

[11] 4,106,150

[45] Aug. 15, 1978

[54] ELEVATED LOADING PLATFORM

[76] Inventor: Robert M. Irwin, 3249 Cherry Ave., Long Beach, Calif. 90807

[21] Appl. No.: 844,891

[22] Filed: Oct. 25, 1977

[51] Int. Cl.[2] ..... E01D 1/00

[52] U.S. Cl. ..... 14/71.3; 61/48

[58] Field of Search ..... 404/71.3, 71.1, 69.5, 404/1; 61/48, 49

[56] References Cited

U.S. PATENT DOCUMENTS

| | | | |
|---|---|---|---|
| 903,157 | 11/1908 | Allen | 14/69.5 X |
| 1,106,074 | 8/1914 | Bidlake | 14/69.5 X |
| 1,674,279 | 6/1928 | Ebeling | 14/69.5 |
| 1,723,885 | 8/1929 | Patterson | 14/71.1 |
| 2,527,653 | 10/1950 | Pierce | 14/71.1 |
| 2,726,123 | 12/1955 | Mathews | 14/69.5 X |
| 3,087,178 | 4/1963 | Loomis | 14/71.3 |
| 3,163,873 | 1/1965 | Hopkins | 14/71.1 |

*Primary Examiner*—Nile C. Byers

*Attorney, Agent, or Firm*—Fulwider, Patton, Rieber, Lee & Utecht

[57] ABSTRACT

There is disclosed a loading platform mounted cantileverally from a vertical spindle carried from a walkway, such mounting being by means of a horizontally extending pivot for rotation of such ramp from a lowered position extending over a loading station to an elevated retracted position adjacent the walkway. A locater is mounted on the swing post for selectively controlling ramp positioning to various angular locations. A ramp extension is slidably mounted for longitudinal extension from the ramp itself. The ramp is counterbalanced to be normally urged to its elevated and retracted position.

12 Claims, 8 Drawing Figures

FIG. 1
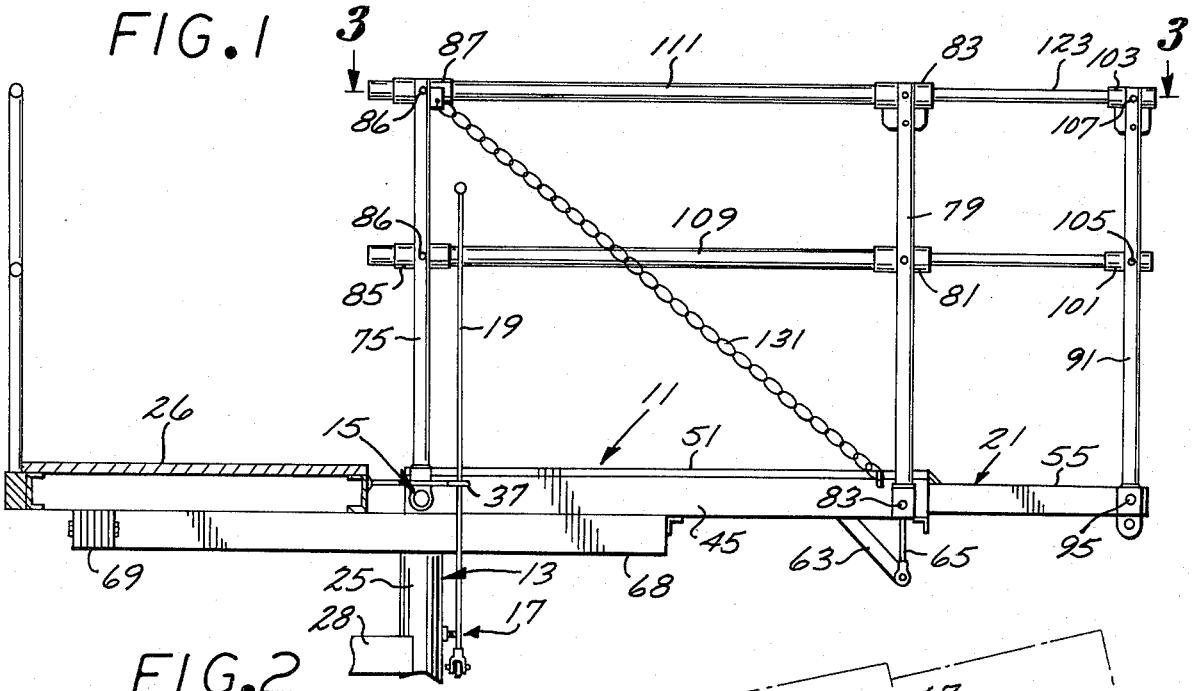
FIG. 2
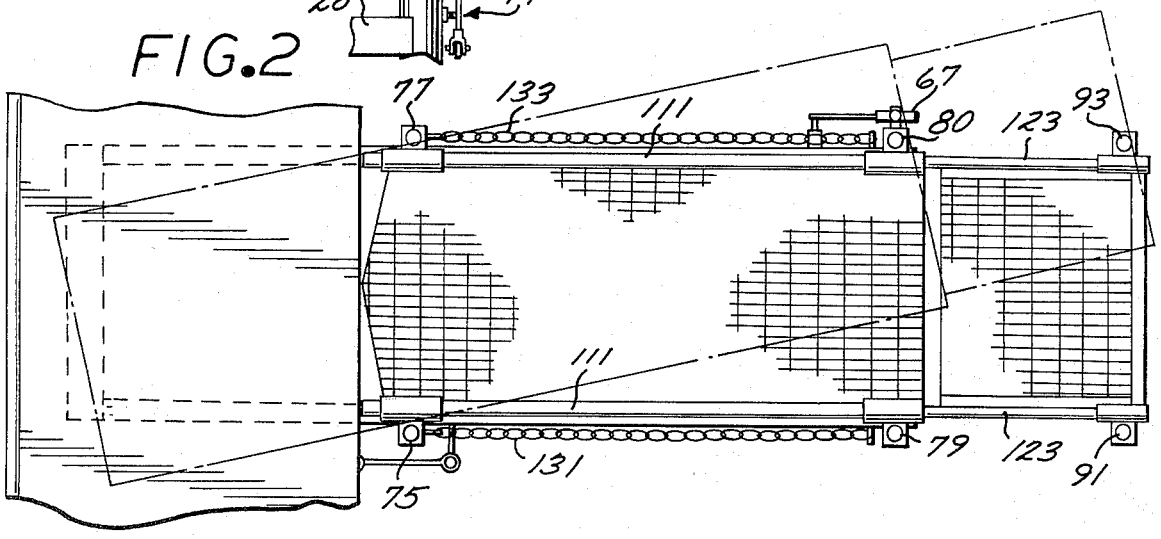
FIG. 3
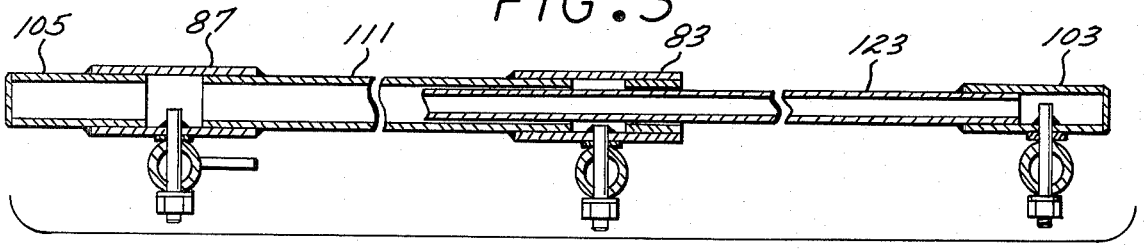
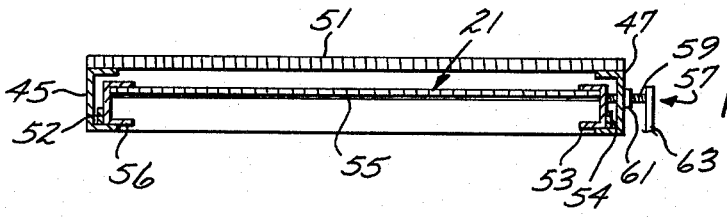
FIG. 4

FIG. 5
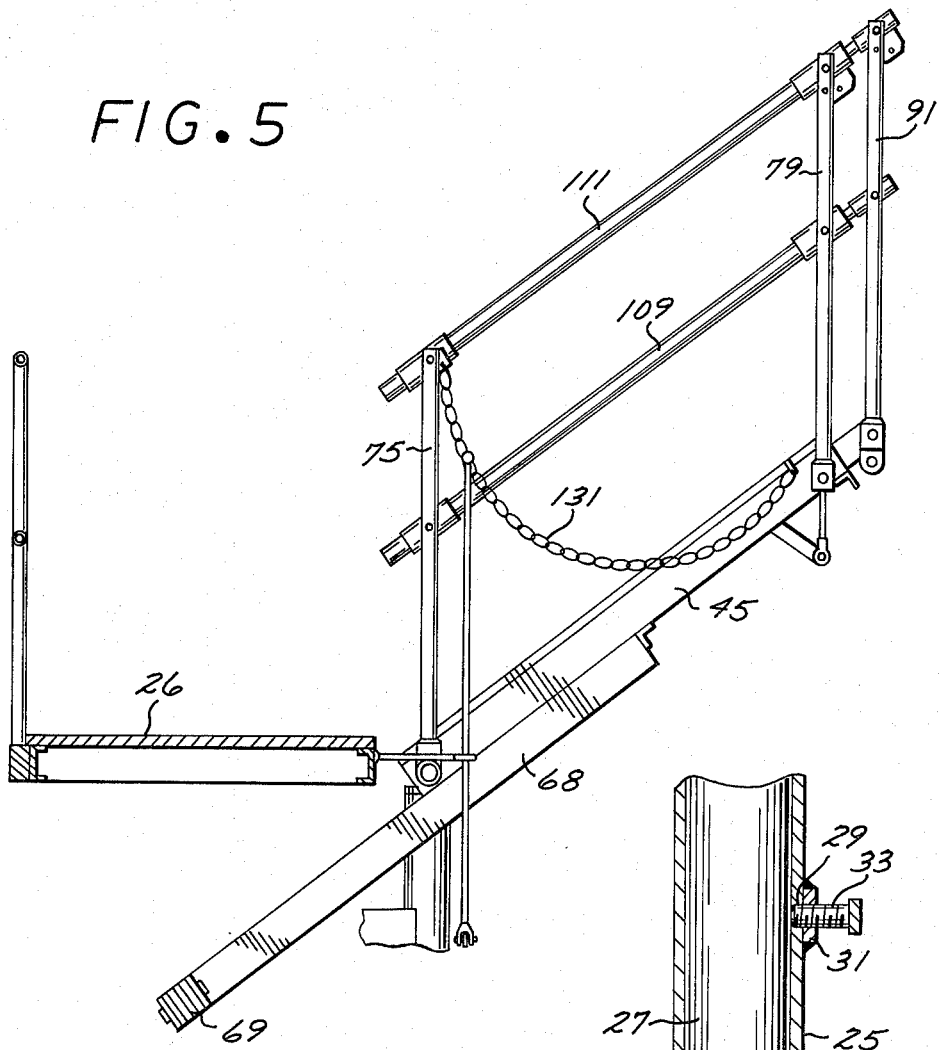
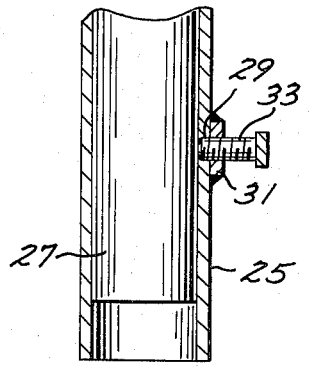
FIG. 7
FIG. 6
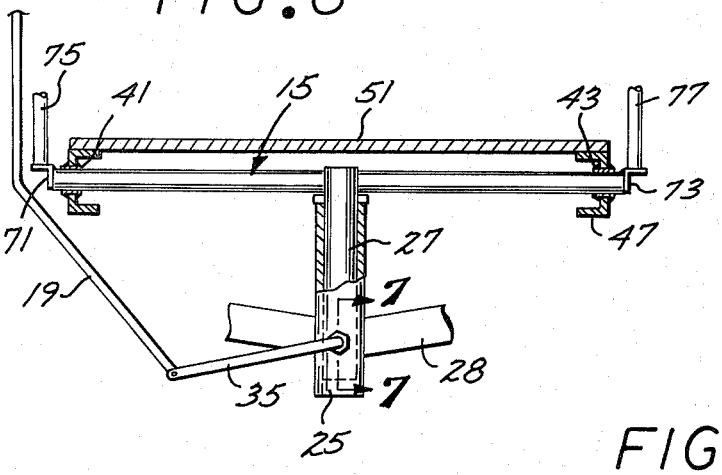
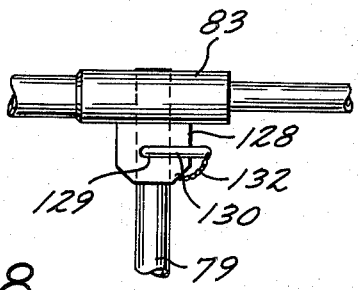
FIG. 8

ELEVATED LOADING PLATFORM

BACKGROUND OF THE INVENTION

1. Field of the Invention

The loading platform of the present invention relates to a support for supporting workmen, conduits, tubing, piping and the like during loading and unloading of railway tank cars and the like.

2. Description of the Prior Art

Numerous efforts have been made to provide a satisfactory loading platform for supporting workmen, pipes, conduits and the like in an elevated position over a railway tank car during loading and unloading thereof. Such efforts have led to the design and construction of support platforms which pivot about horizontal axes to an elevated retracted position. However, such loading platforms do not generally provide for swinging angular adjustment about a vertical axis for lateral shifting of the free extremity of the platform and are generally not extendable.

SUMMARY OF THE INVENTION

The loading platform of the present invention is characterized by a mounting arrangement providing for cantilever mounting of a ramp for angular swinging of the free extremity thereof about a vertical axis while also providing for retraction thereof from a horizontally extending lowered position to an elevated vertical position retracting adjacent an access walkway. The platform preferably includes a ramp extension telescopically mounted from the free end of the ramp itself for selective telescopical extension.

BRIEF DESCRIPTION OF THE DRAWINGS

FIG. 1 is a side elevational view of an elevated loading platform embodying the present invention;

FIG. 2 is a top plan view of the loading platform shown in FIG. 1;

FIG. 3 is a longitudinal sectional view, in enlarged scale, taken along the line 3—3 of FIG. 1;

FIG. 4 is a transverse sectional view, in enlarged scale, taken along the line 4—4 of FIG. 2;

FIG. 5 is a side elevational view similar to FIG. 1, but showing the ramp being retracted to its retracted position;

FIG. 6 is a vertical sectional view, in enlarged scale, taken along the line 6—6 of FIG. 1;

FIG. 7 is a vertical sectional view, in enlarged scale, taken along the line 7—7 of FIG. 6; and FIG. 8 is a detailed view, in enlarged scale, showing a stop pin included in the hand railing on the platform shown in FIG. 1.

DESCRIPTION OF THE PREFERRED EMBODIMENT

Referring to FIG. 1, the elevated loading platform of the present invention includes, generally, a ramp 11 carried cantileverally from a vertically extending swing spindle 13 by means of a horizontally extending elevating pivot rod 15. The swing spindle 13 includes a locater, generally designated 17, having an upwardly projecting actuating handle 19 accessable from the walkway 11 when such walkway is in its lowered position shown in FIG. 1. A ramp extension, generally designated 21, is slideably carried from the free extremity of the ramp 11 for retraction from its extended position shown in FIG. 1 to the retracted position shown in FIG. 3. Consequently, the ramp 11 may conveniently be raised to its elevated position as shown in FIG. 5, or to an even further elevated position to project upwardly and provide clearance therebelow for passage of a train switch engine to position a tank car therebelow. The ramp 11 may then be lowered to the position shown in FIG. 1 to locate the free end thereof over the tank car and the ramp extension 21 adjusted to the desired degree of extension for convenient access to such tank car.

The swing spindle 13 includes a support post 25 (FIG. 7) suspended from the understructure of an access walkway 26 by means of framework 28 and having a stem 27 telescopically received therein and mounting the horizontal pivot rod 15 from the top extremity thereof. With continued reference to FIG. 7, the post 25 is formed with a bore 29 in the wall thereof and has a nut 31 positioned thereover and welded to such post for receipt of a threaded locater stud 33. Referring to FIG. 6, the locater stud 33 has a lever arm 35 rigidly welded to one end thereto and projecting transversely therefrom to have the actuator handle 19 pivotally connected thereto and projecting transversely therefrom to have the actuator handle 19 pivotally connected thereto and projecting upwardly therefrom for telescopical extension through a guide eye 37 (FIG. 1).

Referring to FIG. 6, the pivot rod 15 projects transversely outwardly from opposite sides of the spindle 27 and has a pair of journals 41 and 43 telescoped over the opposite ends thereof, such journals being mounted in the respective one extremities of respective ramp frame channels 45 and 47. The frame channels 45 and 47 project parallel to one another and support therebetween a ramp platform 51. Slideably received into the outer extremity of the channels 45 and 47 are ramp extension channels 53 and 51. Referring to FIG. 4, an extension ramp platform 55 is mounted between the extension frame channels 53 and 51, and travel of such extension ramp 21 under the ramp 11 is guided by means of a pair of parallel guide rails 52 and 54 mounted on the lower flanges of the respective ramp channels 45 and 47.

With continued reference to FIG. 4, a ramp extension locater, generally designated 57, is mounted adjacent the free extremity of the ramp 11 and includes a threaded stud 59 screwed through a nut 61 welded to the ramp channel 47 and projecting through a bore in such channel 47 to engage the ramp extension channel 53. Projecting transversely from the outer extremity of the stud 59 is a rigidly connected lever arm 63 which has its outer extremity pivotally connected with actuator link 55 (FIG. 1) which is formed on its upper extremity with a hand grip handle 67 (FIG. 2).

Referring to FIG. 1, a pair of counterbalance support channels 68 are mounted to the underside of the ramp channels 45 and 47 and project rearwardly beyond the pivot rod 15 to mount thereon counterbalance weights 69 having sufficient weight to counterbalance the ramp 11 and extension 21 to their full vertical raised position.

Referring to FIGS. 1 and 6, a pair of angle iron brackets 71 and 73 are mounted to the opposite ends of the pivot rod 15 and support a pair of respective upstanding rail posts 75 and 77. With continued reference to FIG. 1, a pair of ramp rail posts 79 and 80 are pivotally mounted on their lower extremities to opposite sides of the ramp 11 by means of pivot pins 83 (FIG. 1) and project upwardly to mount vertically spaced apart hand rail pivot bosses 81 and 83 which are, as viewed in FIG.

1, horizontally aligned with similar hand rail pivot bosses 85 and 87 pivotally mounted from the upstanding posts 75 and 77 by means of respective pivot pins 86 and 88.

Referring to FIGS. 1, 2 and 3, a pair of railing posts 91 and 93 are mounted from opposite sides of the ramp extension 21 by means of pivot pins 95 (FIG. 2) and project upwardly to mount vertically spaced apart pivot hand rail bosses 101 and 103 by means of respective pivot pins 105 and 107.

With continued reference to FIG. 3, the upstanding post bosses 85 and 87 have end caps 105 telescopically received in one end thereof and secured thereto. Telescopically received and affixed in the opposite ends of such bosses 85 and 87 are respective one extremities of lower and upper horizontally extending hand rails 109 and 111. The hand rails 109 and 111 telescope on their respective opposite extremities into the respective one ends of the bosses 81 and 83 and are affixed thereto. Received freely telescopically in the opposite ends of the bosses 81 and 83 are respective lower and upper ramp extension hand rails 121 and 123 which project along opposite sides of the ramp extension 21 and telescope freely into the respective hand rails 109 and 111. The opposite ends of such extension hand rails telescope into respective one ends of the capped bores 101 and 103.

Referring to FIGS. 1 and 8, respective stop plates 128 depend from the respective pivotal bosses 83 and are formed with a respective horizontal slot 129 which aligns with bores formed in the walls of the respective railing posts 81 and 79 for receipt of respective quick release locking pins 130 which are conveniently attached to the respective posts 79 and 81 by means of respective tether chains 132 for locking the platform in its down position.

Referring to FIGS. 1 and 2, a pair of safety chains 131 and 133 are disposed on opposite sides of the ramp 11 and are affixed in their upper ends to the tops of the respective upstanding, stationary posts 75 and 77 and angle downwardly, when the ramp is in its lowered position (FIG. 1), to be secured on their respective lower extremities to the free end of the ramp 11. Consequently, not only is the downward swing of the ramp 11 stopped by contact of the rearward extremities of the counterweight support channels 68 with the framework of the walkway 26, but security against failure of such channels 68 to stop downward swing is provided by such safety chains 131 and 133.

In operation, the loading ramp 11 is normally stored in its fully retracted position as dictated by the retractive force produced by the counterweights 69 (FIG. 5). It will be apparent that the degree of retraction under the influence of the counterbalance weights 69 is controlled by the overall weight thereof, combined with the lever arm as defined by the distance from the pivot rod 15 to the center of gravity for such weights. Thus, the area immediately below the platform is clear for receipt of a tank car or the like which is to be loaded or unloaded. A switch engine or the like may then pass beneath the platform to position a first tank car therebelow at an approximate transverse location, with respect to the access of such ramp 11, and a workman may then approach the ramp from the walkway 26. The workman need merely push the ramp 11 outwardly from the vertical retracted position and when such ramp assumes the inclination shown in FIG. 5 it is sufficiently lowered so the workman can commence walking out on such ramp to combine his weight with the overall weight of the platform to overcome the weight of the counterbalance weights 69 bringing such ramp 11 to its fully lowered position shown in FIG. 1. The workman may then extend the ramp extension 21 by pushing outwardly on the railing posts 91 and 93 to fully extend such extension over the tank car and may then lock such extension in its fully extended position by merely grasping the locater handle 67 (FIG. 2) and pulling upwardly thereon to draw the lever arm 63 (FIG. 1) upwardly to screw the ramp extension locater stud 59 inwardly, as best seen in FIG. 4, to contact the inner end thereof with the ramp extension channel 53 and urge such extension ramp 21 to the left against the guide rail 52 thereby frictionally locking it in its extended location. The ramp is locked in its lowered position by inserting lock pins 130 to lock the bosses 83 against rotation relative to the posts 79, thus locking the parallelogrammatic railing against raising.

The workman may then reach the tank car structure and swing himself, and the ramp 11, about the swing spindle 13 to locate the extended extremity of the extension ramp 21 at the desired angular location for convenient access to such tank car and may lock such ramp 11 at the set angular location by drawing upwardly on the swing locater handle 19 (FIG. 1) to draw upwardly on the outer extremity of the locater lever arm 35 (FIG. 6) to screw the locater stud 33 inwardly (FIG. 7) to contact the inner extremity thereof with the stem 27 supporting the ramp 11. The loading platform is then ready for use in loading or unloading the tank car.

It will be appreciated that once work on the platform has been completed for that particular tank car, the workman need merely release the extension ramp locater handle 67 (FIG. 2) to free the ramp extension 21 for retraction and may, if desirable, release the swing locater handle 19 (FIG. 1) to free the swing stem 27 (FIG. 7) so it can swing the ramp 11 to its angular position projecting perpendicular to the walkway 26. The stop pin 130 (FIG. 8) may then be withdrawn to release the parallelogrammatic railing so when the workman walks off the ramp 11 and onto the walkway 26, such ramp 11 will be automatically raised under the influence of the counterweights 69 and when it approaches the fully retracted position, the slide extension 21 will automatically retract between the guide rails 52 and 54 (FIG. 4) to the retracted position shown in FIG. 5. The stored ramp 11 is thus cleared of rail cars and engines passing therebelow until subsequent use thereof is required.

From the foregoing, it will be appreciated that the elevated loading platform of the present invention provides a convenient and safe means for loading or unloading railway tank cars and the like and provides for automatic retraction and storage thereof.

Various modifications and changes may be made with regard to the foregoing detailed description without departing from the spirit of the invention.

I claim:

1. An elevated loading platform to be suspended from an elevated walkway adjacent a loading station for receiving a railroad tank car or the like and comprising:

a retractable ramp extendable to a position over said loading station;

swivel means mounted on said walkway and pivotable about a vertical axis;

pivot means mounted on said swivel means and cantileverally mounting said retractable ramp for pivoting between a lowered position projecting over said loading station and an elevated position elevated above said swivel means and projecting upwardly adjacent said walkway;

ramp limit means mounted from said walkway for limiting downward travel of said ramp past said lowered position;

swing locater means mounted on said swing means and including a handle accessable from said ramp for actuating said locater means to lock said swing means in a selected position locating said ramp in a desired orientation over said loading station;

counterbalance means coupled with said ramp and said pivot means for counterbalancing said ramp to its elevated position;

a ramp extension; and slide means carrying said ramp extension from said ramp for selective extension thereof relative to said ramp whereby said car may be pulled into said location and a workman on said walkway may push the upper extremity of said ramp outwardly to pivot downwardly toward said lowered position and said workman may walk outwardly onto said ramp to weight it down to said lowered position, said ramp then swing to the desired angular location, said locater means activated to lock it there, and said extension then extended to extend said extension to the desired position over said locating station.

2. An elevated loading platform as set forth in claim 1 wherein:

said locater means includes a lock rotatable to lock said swing means in the desired location and a lever arm therefrom; and said handle includes a rod projecting upwardly from the free end of said lever arm.

3. An elevated loading platform as set forth in claim 1 wherein:

said slide means includes a pair of parallel tracks carrying said ramp and a pair of slides slidable therein and carrying said ramp extension.

4. An elevated loading platform as set forth in claim 1 that includes:

hollow hand railing mounted on opposite sides of said ramp; and extension hand railing mounted on opposite sides of said ramp extension and telescopically received in said hollow hand railing upon retraction of said ramp extension relative to said ramp.

5. An elevated loading platform as set forth in claim 1 wherein:

said swing means includes a vertical hollow post supported from said walkway and a stem journaled thereinto, said post being formed with a through bore in the wall thereof; and said locater means includes a location stud projecting through said bore and engageable with said stem.

6. An elevated loading platform as set forth in claim 1 wherein:

said pivot means includes a pivot shaft projecting horizontally in opposite directions from said swing means and a pair of journals on opposite sides of said ramp and telescoped over the opposite extremities of said shaft.

7. An elevated loading platform as set forth in claim 1 wherein:

said ramp limit means includes an upstanding post mounted on said walkway and a safety chain connected on one end to the upper extremity thereof and connected on its opposite end to the free end of said ramp.

8. An elevated loading platform as set forth in claim 1 that includes:

railing mounted on opposite sides of said ramp and including a pair of upstanding posts disposed and rigidly mounted from said walkway on opposite sides of said ramp, and a pair of ramp posts pivotally mounted from the opposite sides of the free extremity of said ramp, said railing further including a pair of hand rails pivotally carried on their opposite extremities from said respective upstanding posts and ramp posts to cooperate with said posts and ramp to form a parallelogram.

9. An elevated loading platform as set forth in claim 1 that includes:

a releasable lock carried on said ramp for locking said ramp in its lowered position.

10. An elevated loading platform as set forth in claim 1 that includes:

a ramp extension lock carried on said ramp and engageable with said slide means, said ramp extension lock including handle means accessable from said ramp.

11. An elevated loading platform as set forth in claim 8 wherein:

said ramp limit includes a pair of chains connected on their respective one extremities with the tops of said upstanding posts and on their opposite extremities with the free extremity of said ramp.

12. An elevated loading platform as set forth in claim 8 wherein:

said railing includes a pair of upstanding ramp extension posts pivotally mounted at their lower extremities from the opposite sides of the free end of said ramp extension, said hand rails are hollow and said railing further includes a pair of extension hand rails pivotally mounted on their respective one extremities from said ramp extension posts and freely telescoped on their opposite extremities into the respective ends of said hollow hand rails.

* * * * *